United States Patent [19]

Gentile

[11] 4,077,382

[45] Mar. 7, 1978

[54] ROTARY VALVE FOR INTERNAL COMBUSTION ENGINES

[76] Inventor: Carl A. Gentile, 260 Chase Rd., Columbus, Ohio 43214

[21] Appl. No.: 619,947

[22] Filed: Oct. 6, 1975

[51] Int. Cl.[2] ..... F01L 7/00

[52] U.S. Cl. ..... 123/190 A; 123/80 BA; 123/190 R

[58] Field of Search ..... 123/80 R, 80 BA, 190 R, 123/190 A, 190 E

[56] References Cited

U.S. PATENT DOCUMENTS

| | | | |
|---|---|---|---|
| 1,135,719 | 4/1915 | Ritter | 123/190 A |
| 1,193,620 | 8/1916 | Ryon | 123/80 BA |
| 1,215,993 | 2/1917 | Rimbach | 123/80 BA |
| 1,218,296 | 3/1917 | Moorhead | 123/190 A |
| 1,762,088 | 6/1930 | Burkhardt | 123/80 BA |
| 2,183,024 | 12/1939 | Large | 123/190 A |
| 3,893,483 | 7/1975 | Ackerman | 123/190 A |

FOREIGN PATENT DOCUMENTS

| | | | |
|---|---|---|---|
| 919,378 | 9/1954 | Germany | 123/190 A |

*Primary Examiner*—Charles J. Myhre
*Assistant Examiner*—David D. Reynolds
*Attorney, Agent, or Firm*—Mahoney & Stebens

[57] ABSTRACT

Rotary valve apparatus is provided for internal combustion engines. The rotary valve apparatus includes separate valve elements for each cylinder of a multicylinder engine with exhaust and intake valves mounted in the engine head for rotation in selectively adjustable, predetermined timed relationship. The valve elements, both intake and exhaust, are disposed in respective isolated valve chambers to prevent direct interaction therebetween.

9 Claims, 6 Drawing Figures

ROTARY VALVE FOR INTERNAL COMBUSTION ENGINES

BACKGROUND OF THE INVENTION

Substantial effort has heretofore been expended in development of rotary valve apparatus for internal combustion engines. This effort is warranted because of the basic inefficiency of the conventional type of reciprocating valves that have been almost exclusively utilized for such engines. The reciprocating type of valve substantially interferes with gas flow in that the valve head is always disposed in the path of the gases resulting in flow-path distortion that materially reduces and restricts the gas flow into or out of a cylinder. Furthermore, mechanical actuation of reciprocating valves represents an additional energy loss in view of the numerous components that are necessary for operation. While a cam in head engine eliminates the push rods that are otherwise required, the cam mechanism does include levers and springs for maintaining the valves in a closed position. The levers and springs require expenditure of a certain amount of energy for operation which further reduces engine efficiency.

Rotary valve mechanisms known to have been developed for internal combustion engines has either comprised elongated tubes that connect with several cylinders or disc-type valve elements disposed in each cylinder. Neither of these two types of rotary valve mechanisms have been found to be as effective or as efficient as desired or possessing sufficient advantages over the reciprocating valves.

SUMMARY OF THE INVENTION

The rotary valve apparatus of this invention comprises independent valve elements for both intake and exhaust parts of each cylinder with each valve element disposed in its own chamber. Each valve element comprises a cylindrical shell that is open at one end and has a port formed in the cylindrical wall. A port is also formed in each valve chamber and which communicates with the respective engine cylinder. Rotation of the valve results in periodic alignment of the valve part with the cylinder part thus permitting gas flow therethrough, either intake or exhaust, in timed relationship with piston movement. All intake valve elements are mounted on a common drive shaft for concurrent revolving of all intake valves. Similarly, all exhaust valve elements are mounted on their own common drive shaft for revolution independent of but in timed relationship to the intake valves.

Separate cylindrical valve chambers are formed in the engine head for each valve element, both intake and exhaust. In addition to the previously mentioned ports communticating with the engine cylinders, each valve chamber is provided with a respective port communicating with the induction system or the exhaust system. This providing of separate valve chambers results in an advantageous isolation of the valve elements and an adjacent portion of the associated induction or exhaust system for more efficient engine operation.

Separate drive shafts for the intake and exhaust valves also permits selective adjustment of timed relationship between the intake and exhaust valves. This adjustability enables operation of an engine over a substantially greater speed range than would otherwise be possible.

These and other objects and advantages of this invention will be readily apparent from the following detailed description of an embodiment thereof and the accompanying drawings.

DETAILED DESCRIPTION OF THE ILLUSTRATIVE EMBODIMENT

Figure 1:
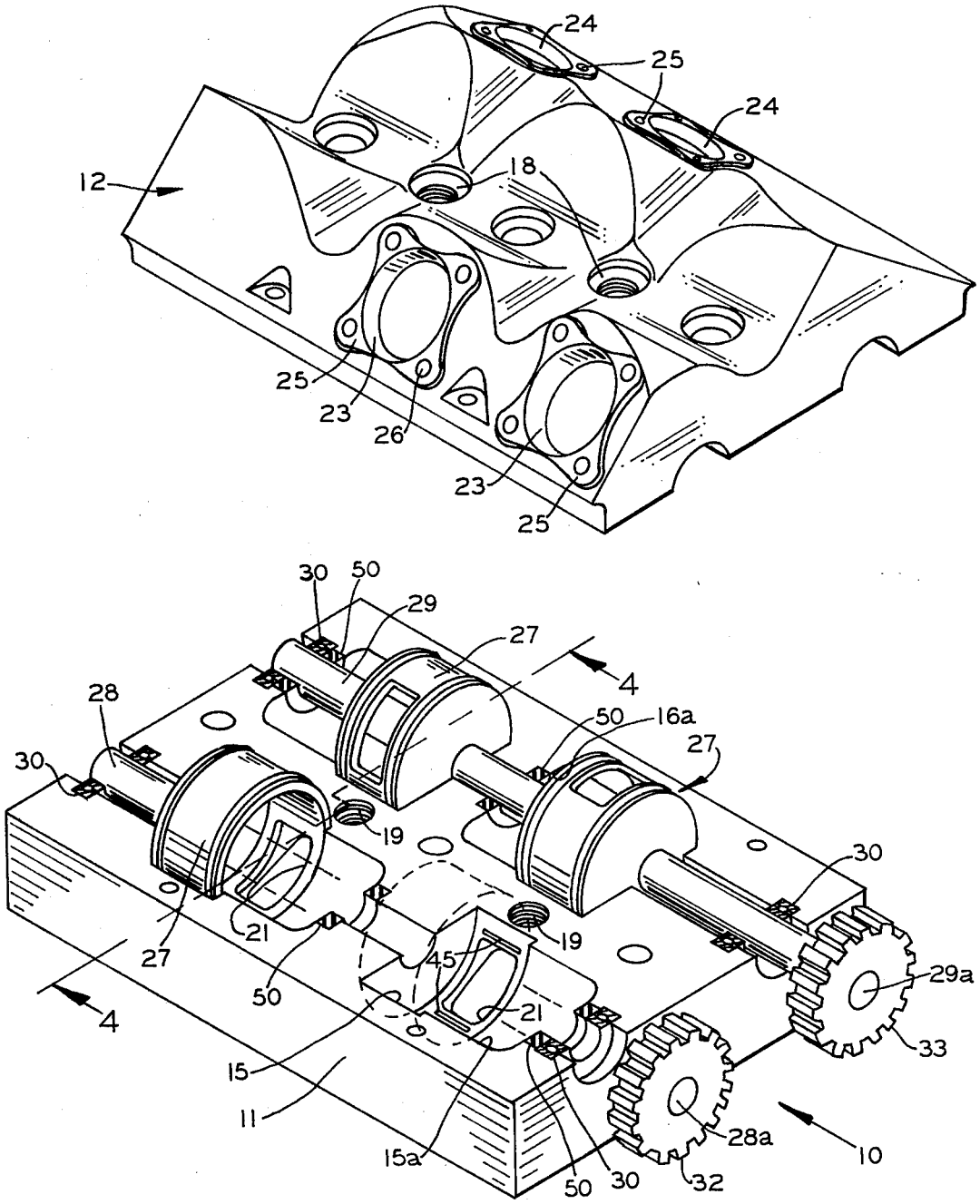
FIG. 1 is an exploded perspective view of a cylinder head provided with the rotary valve apparatus of this invention.
Figure 4:
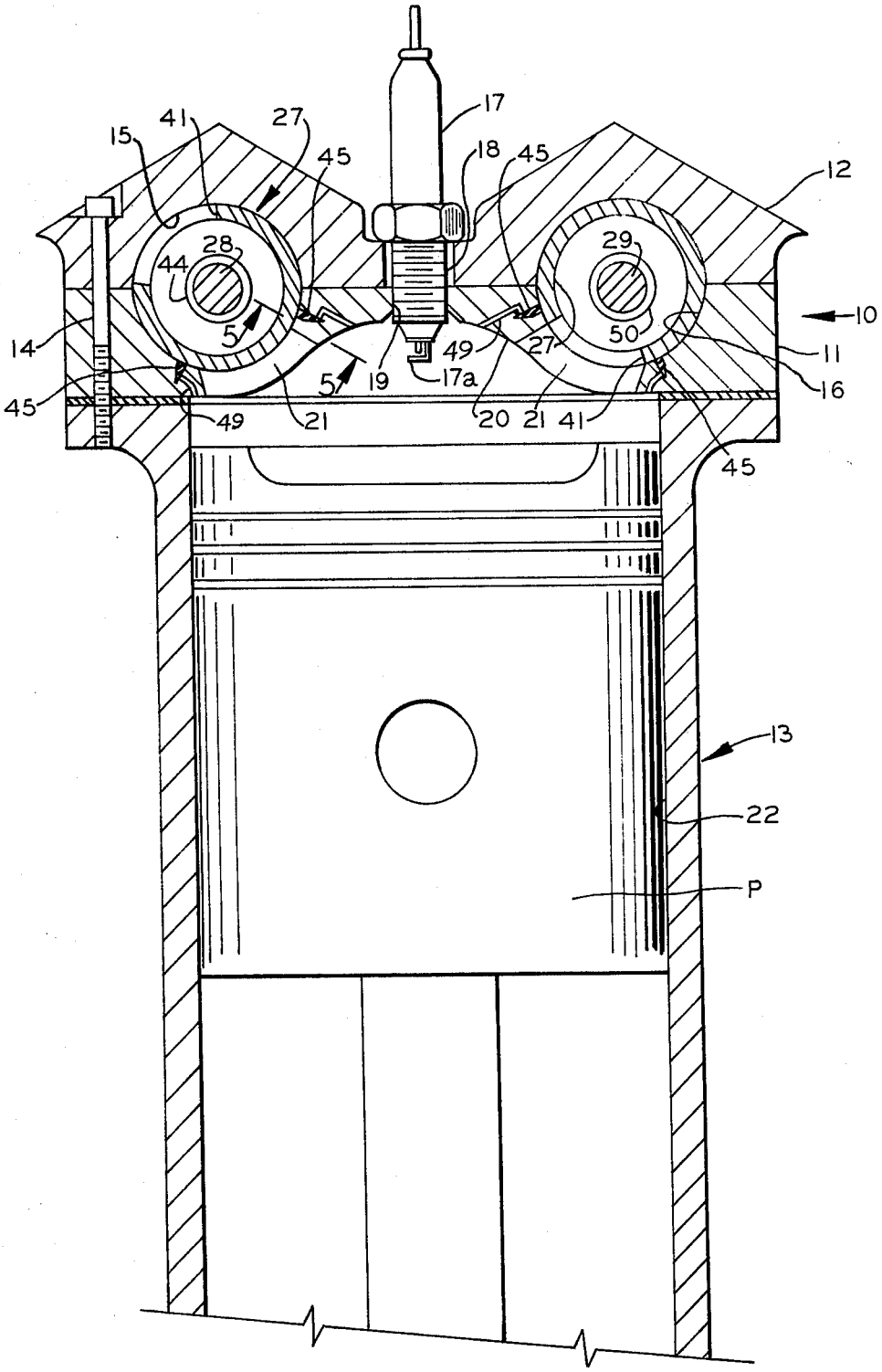
FIG. 4 is a vertical sectional view of an engine provided with the rotary valve apparatus of this invention with this sectional view taken along line 4—4 of FIG. 1.

A cylinder head 10 is shown in FIG. 1 for an internal combustion engine having two cylinders with this head being fabricated in two sections 11 and 12 which are designated lower and upper sections respectively. Both sections are adapted to interfit in superposed relationship and to be secured to the top of a cylinder block 13 for an internal combustion engine by means of bolts 14 as shown in FIG. 4. The illustrative embodiment is a two cylinder engine but it will be understood that the number of cylinders may be increased and that the rotary valve apparatus may also be readily adapted to a V-block engine.

Formed in the two sections of the cylinder head are the respective mating halves of the valve chambers 15 and 16, intake and exhaust, respectively. These valve chambers are elongated cylinders with all of the intake chambers disposed in axially aligned relationship as are the exhaust chambers. It will also be noted that the longitudinally aligned sets of chambers 15 and 16 are laterally spaced apart in parallel relationship with the space therebetween providing a place for receiving an ignition plug 17 as shown in FIG. 4. The base of the ignition plug 17 projects through an aperture 18 provided in the upper head section 12 and is threaded into a socket 19 formed in the lower head section 11 with the electrodes **17*a* of the ignition plug extending into a head chamber 20 formed in the lower surface of the lower head section 11**.

Each of the intake and exhaust valve chambers 15 and 16 is formed with a coaxial extension, **15*a* and 16*a*, respectively. These coaxial extensions as will be subsequently described in greater detail relative to a discussion of gas flow into or out of the valve chambers. The main portion of each valve chamber 15 and 16** as previously stated is an elongated cylinder of predetermined length and diameter to receive a respective valve element to be described hereinafter. The chamber extensions are also of elongated, cylindrical configuration but the diameter thereof immediately adjacent the respective main chamber is of slightly smaller diameter with the remote end portion being arcuately configured.

The lower setion 11 of the cylinder head is also provided with valve ports 21 in the respective valve chambers 15 and 16 and which communicate with a cylinder 22 in the cylinder block 13. A reciprocating piston P is included in the cylinder 22 for operation in a conventional manner. The valve ports 21 are of the illustrated elongated rectangle configuration extending circumferentially relative to the cylindrical surface of the valve chamber in alignment with the ignition plug socket 19. This places the valve ports 21 in diametrically disposed relationship to the associated cylinder for optimum uniformity in gas flow during the cyclic operation of the engine.

Formed in the upper section 12 of the cylinder head are intake and exhaust ports 23 and 24, respectively. These ports open to the respective valve chamber extensions 15*a* and 16*a* and are longitudinally displaced in offset relationship to the valve ports 21. Mounting bosses 25 with threaded bolt holes 26 are formed on the exterior surface of the upper head section 12 around the periphery of the intake and exhaust ports 24 and 25 to facilitate connection of induction and exhaust conduits (not shown).

Positioned in each of the valve chambers 15 and 16 is a rotary valve element 27 with all intake valves secured on a common dirve shaft 28 and all exhuast valves secured on a second common drive shaft 29. Each drive shaft 28, 29 is journalled in bearings 30 with each shaft having a respective end portion 28*a*, 29*a* extending through an end wall 31 of the cylinder head 10. The bearings 30 are disposed in respective bearing seats formed in the upper and lower head sections 11 and 12. Mounted on each end portion 28*a* and 29*a*, respectively, is a valve drive gear 32, 33. A driving mechanism (not shown) is connected to the gears 32 and 33 and this mechanism may advantageously be of a type which permits selective adjustment of the valve timing relative to the crankshaft (piston position) and selective relative adjustment of the intake and exhaust valve timing. Mechanism for effecting such selective adjustment is well known in the art and, therefore, is not shown in the drawings as it is not necessary for an understanding of this invention.

Figure 2:
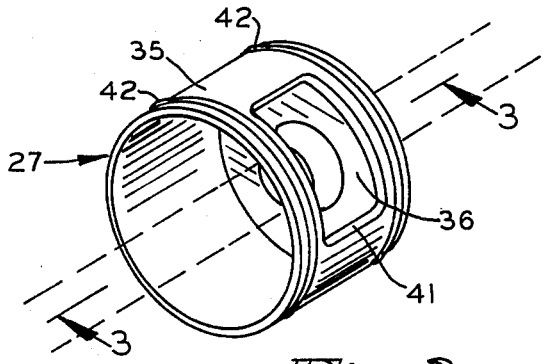
FIG. 2 is a perspective view of one valve element thereof shown on an enlarged scale.
Figure 3:
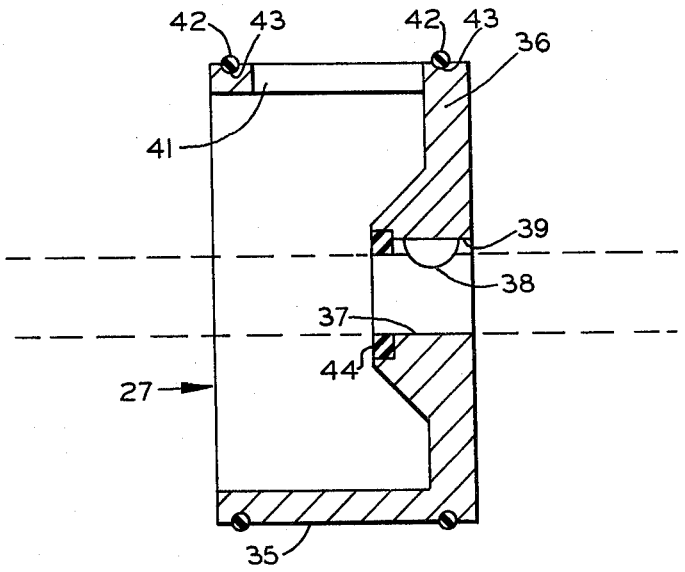
FIG. 3 is a medial sectional view taken along line 3—3 of FIG. 2.

As can be best seen in FIGS. 2 and 3, the rotary valve element 27 comprise a cylindrical tube 35 that is open at one end and is integrally formed with an annular mounting hub 36. The hub 36 closes the one end of the cylindrical tube 35 and includes a coaxial bore 37 through which the respective shafts, 28 or 29, and on which the valve elements are fixed in driving relationship. A suitable driving relationship may be effectively obtained by a key 38 adapted to fit into a recess (not shown) formed in the shaft and interengaging with an axial slot 39 in the bore 37. It will be noted that the thickness of the cylindrical tube is such that the internal surface thereof is contiguous with the chamber axial extensions 15*a* and 16*a* for better fluid flow.

An aperture 41 of rectangular shape is formed in the wall of the cylindrical tube 35 of each valve element 27. This aperture 41 is of predetermined length and is of a width and length commensurate with the width and length of the respective valve ports 21 formed in the valve chambers. The apertures 41 are axially positioned in the cylindrical tubes 35 such that with the valve elements positioned in a respective valve chamber, 15, or 16, the apertures will align with the valve ports to permit gas flow into or out of the cylinder by means of the open end of the cylindrical tube and coincident aperture and valve port. The specific lengths of the valve ports 21 and apertures 41 are determined by the particular engine performance characteristics that are desired with due regard to overlap and open-port times.

Effective fluid-tight sealing of the rotary valve elements 27 in their respective chambers 15 or 16 is achieved by means of resilient sealing elements. These sealing elements are fabricated from materials capable of withstanding the relatively high temperatures encountered in engine operations. Two of these sealing elements comprise a pair of rings 42 disposed in respective circumferentially extending grooves 43 formed in the outer cylindrical surface of the valve element 27. These respective pairs of rings 42 are disposed at opposite sides of an aperture 41. An additional sealing ring 44 disposed in circumferential groove formed in the hub bore 37 may be provided to further assure complete sealing of the valve element.

Figure 5:
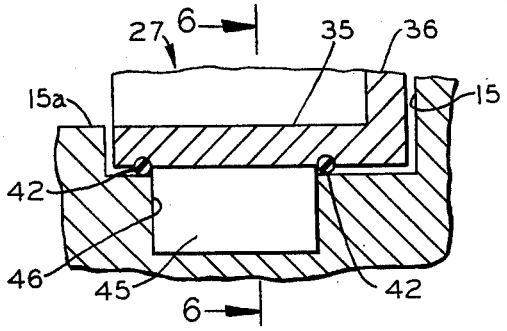
FIG. 5 is a fragmentary sectional view on an enlarged scale taken along line 5—5 of FIG. 4.
Figure 6:
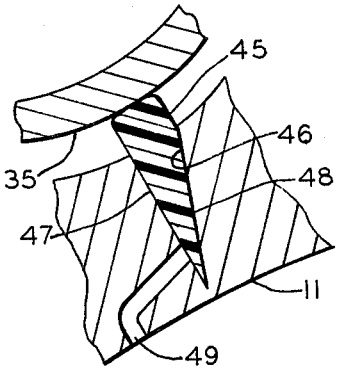
FIG. 6 is a substantially enlarge sectional view taken along line 6—6 of FIG. 5.

Completing sealing of each rotary valve element 27 is a pair of axially extending sealing elements 45. These sealing elements 45 are disposed in respective slots 46 which are formed in the wall of the valve chamber at opposite ends of the valve port 21 as can be best seen in FIG. 1. FIGS. 5 and 6 illustrate the structure and operation of these seals in substantially greater detail with these seals projecting from their respective slots 46 into contacting engagement with the exterior surface of the rotary valve element 27. Each of these axial sealing elements 45 is preferably formed with a side surface 47 which is effectively perpendicular to valve chamber and a side surface 48 that is relatively inclined to the other surface 47 and which mate with similarly shaped side walls of respective slot 46. A passageway 49 formed in the head section 11 opens to the head chamber 20 and to side wall 47 of the slot permitting fluid communication therebetween. The operational function of this structural arrangement is that, during cyclic operation of the engine, gas pressure developed within a cylinder during power strokes will produce a force acting on the axial sealing element 45 that will tend to force the sealing element out of its slot and into positive sealing engagement with the surface of the valve element. This outwardly directed force results from the fluid pressure in the passageway 49 effectively acting on the inclined surface of the slot 46.

A shaft seal 50 is also positioned in a cooperative recess in the end of each valve chamber extension 15*a* and 16*a*. These seals 50 are located at the end of the chamber opposite that where the valve element is positioned and complete the sealing of each rotary valve element 27 in its respective chamber 15 or 16.

The rotary valve apparatus disclosed herein provides substantial operational advantages over the valve apparatus of the known prior art and which advantages materially enhances the efficiency and performance of an internal combustion engine. The rotary valves are inherently more efficient in controlling gas flow into and out of the engine cylinder through the ability to locate the ports 21 in relatively opposed relationship. This opposed relationship coupled with the flow path from or to the valve chamber that is relatively obstruction free results in an optimum gas flow for scavenging of the gases from the cylinder at the conclusion of the power stroke as well as facilitating the intake or exhaust of the gases. A further particularly important advantage obtained is the substantially effective isolation of the valve chambers from each other. This isolation materially reduces the interference effect resulting from the alternating flow patterns which would otherwise detract from the more desirable laminar flow patterns obtained with this apparatus. Also, selectivity in adjustment of relative valve positions as to intake and exhaust permits operation at the most efficient setting in accordance with power and speed requirements.

Having thus described this invention, what is claimed is:

1. Rotary valve apparatus for an internal combustion engine comprising a cylinder head for an engine which includes at least one cylinder with the cylinder head adapted for mounting on the engine in operative relationship to the cylinder, said cylinder head having formed therein an intake valve chamber and an exhaust valve chamber, each of said chambers being of elongated cylindrical configuration, valve ports providing fluid communication between respective valve chambers and the engine cylinder and an intake port and an exhaust port providing fluid communication between a respective valve chamber and a respective intake or exhaust manifold; and a rotary valve element of elongated cylindrical configuration coaxially disposed in each of said valve chambers for revolving movement in fluid flow controlling relationship to the respective valve port, each rotary valve element including a cylindrical tube mounted on a respective rotatable drive shaft journalled in said cylinder head and having an open end in fluid communication with either the respective intake or exhaust port and an aperture formed in a cylindrical wall thereof at a position to align with the respective valve port for a predetermined time interval during each revolution of said rotary valve element and permit fluid flow therethrough, each of said valve chambers being of a length to extend a distance axially from the open end of the valve element, said intake or exhaust port communicating with the respective chamber extension.

2. Rotary valve apparatus according to claim 1 wherein said valve chambers are relatively oriented with the respective valve ports disposed in diametrically opposed relationship to the engine cylinder.

3. Rotary valve apparatus according to claim 1 wherein said rotary valve elements are disposed with their axis of revolution in spaced parallel relationship.

4. Rotary valve apparatus according to claim 3 wherein said valve chambers are relatively oriented with the respective valve ports disposed in diametrically opposed relationship to the engine cylinder, and said cylinder head includes a mounting for an ignition plug positioned between the said valve ports.

5. Rotary valve apparatus according to claim 1 wherein the aperture formed in the wall of each cylindrical tube extends a predetermined distance circumferentially around said tube.

6. Rotary valve apparatus according to claim 5 wherein each said valve port extends the same distance circumferentially of the respective valve chamber as the aperture in the rotary valve element.

7. Rotary valve apparatus according to claim 1 having a plurality of cylinders and including respective sets of valve chambers for each cylinder, each of said valve chambers being isolated from the others and in independent fluid communication with a respective intake or exhaust manifold.

8. Rotary valve apparatus for an internal combustion engine comprising a cylinder head for an engine which includes at least one cylinder with the cylinder head adapted for mounting on the engine in operative relationship to the cylinder, said cylinder head having formed therein an intake valve chamber and an exhaust valve chamber, each of said chambers being of elongated cylindrical configuration, valve ports providing fluid communication between respective valve chambers and the engine cylinder and an intake port and an exhaust port providing fluid communication between a respective valve chamber and a respective intake or exhaust manifold; and a rotary valve element of elongated cylindrical configuration coaxially disposed in each of said valve chambers for revolving movement in fluid flow controlling relationship to the respective valve port, each rotary valve element including a cylindrical tube mounted on a respective rotatable drive shaft journalled in said cylinder head and having an open end in fluid communication with either the respective intake or exhaust port and an aperture formed in a cylindrical wall thereof at a position to align with the respective valve port for a predetermined time interval during each revolution of said rotary valve element and permit fluid flow therethrough, the cylindrical tube of each said rotary valve element being closed at the other end and said aperture being of an elongated rectangular configuration having an axial dimension commensurate with that of the valve port, each of said valve chamber being of a length to extend a distance axially from the open end of the valve element, said intake or exhaust port communicating with the respective chamber extension.

9. Rotary valve apparatus according to claim 8 having fluid sealing means cooperating between the opposed surfaces of the rotary valve element and valve chamber to prevent fluid leakage therebetween when said aperture is not revolved into fluid communicating relationship with said valve port.

* * * * *